United States Patent [19]

Tanaka et al.

[11] Patent Number: 4,679,996

[45] Date of Patent: Jul. 14, 1987

[54] ROTARY MACHINE HAVING SCREW ROTOR ASSEMBLY

[75] Inventors: Masanori Tanaka, Niigata; Atsushi Maehara, Bunsuimachi; Junichi Kanai, Yoshidamachi, all of Japan

[73] Assignee: Hokuetsu Industries Co., Ltd., Nishikanbara, Japan

[21] Appl. No.: 878,800

[22] Filed: Jun. 26, 1986

[30] Foreign Application Priority Data

Jun. 29, 1985 [JP] Japan ..... 60-99297[U]

[51] Int. Cl.[4] ..... F04C 18/16

[52] U.S. Cl. ..... 418/201

[58] Field of Search ..... 418/150, 201; 74/424.5, 74/458

[56] References Cited

U.S. PATENT DOCUMENTS

| | | | |
|---|---|---|---|
| 4,435,139 | 3/1984 | Astberg | 418/201 |
| 4,460,322 | 7/1984 | Schibbye | 418/201 |
| 4,508,496 | 4/1985 | Bowman | 418/201 |
| 4,527,967 | 7/1985 | Ingalls | 418/201 |
| 4,576,558 | 3/1986 | Tanaka et al. | 418/201 |
| 4,583,927 | 4/1986 | Shigekawa | 418/201 |

*Primary Examiner*—Carlton R. Croyle
*Assistant Examiner*—Jane E. Obee
*Attorney, Agent, or Firm*—Oblon, Fisher, Spivak, McClelland & Maier

[57] ABSTRACT

Rotary machine such as rotary compressor or expander having meshed male and female rotor assembly. The tooth profile of the female rotor is formed such that a line ($H_2$-$A_2$) is formed by a generated curve of a point $A_1$ of the male rotor; a line ($A_2$-$B_2$) is formed by a circular arc having a point $O_7$ as the center of the arc and a radius $R_7$; a curve ($B_2$-$C_2$) is formed by an envelope developed by a circular arc ($B_1$-$C_1$) of the male rotor; a portion between points $D_2$ and $E_2$ is formed by a circular arc having a point $O_1$ as the center of the arc and a radius $R_1$; a line ($C_2$-$D_2$) is formed by a line smoothly connecting the curves ($B_2$-$C_2$) and ($D_2$-$E_2$); a curve ($E_2$-$F_2$) is formed by a circular arc having a point $O_2$ as the center of the arc and a radius $R_2$; and a curve ($F_2$-$G_2$) is formed by a circular arc having a point $O_8$ as the center of the arc and a radius $R_8$. The tooth profile of the male rotor is formed such that a curve ($H_1$-$A_1$) is formed by a generated curve of a point $H_2$ of the female rotor; a curve ($A_1$-$B_1$) is formed by an envelope developed by the arc ($A_2$-$B_2$) of the female rotor; a curve ($B_1$-$C_1$) is formed by a circular arc having a point $O_4$ as the center of the arc and a radius $R_4$; a curve ($D_3$-$E'_1$) is a circular arc having a point $O_6$ as the center of the arc and a radius $R_6$; a curve ($E_1'$-$E_1$) is an envelope developed by an arc ($D_2$-$E_2$) of the female rotor; curves ($E_1$-$F_1$) and ($F_1$-$G_1$) are generated by arcs ($E_2$-$F_2$) and ($F_2$-$G_2$) of the female rotor tooth profile, respectively, and a seal strip is formed between points $C_1$ and $D_3$.

3 Claims, 13 Drawing Figures

ROTARY MACHINE HAVING SCREW ROTOR ASSEMBLY

BACKGROUND OF THE INVENTION

1. Field of the Invention

The present invention relates to a screw rotor machine for compressing or expanding a compressible fluid and supplying the compressed or expanded fluid, and is particularly characterized by a toothprofile curve thereof.

The rotary machines termed in the present invention generally include a compressor, an expanding machine, a fluid motor, an internal combustion engine and the like.

2. Discussion of the Background

Rotors having nonsymmetrical tooth profiles and used in a compressor or the like of a compressible fluid generally comprise a male rotor having helical lands with a major portion of each tooth profile outside the pitch circle thereof, and a female rotor having helical grooves with a major portion of each tooth profile inside the pitch circle thereof. Normally, the male rotor has a plurality of teeth, and the female rotor meshing therewith has a number of teeth slightly exceeding the number of teeth of the male rotor. The diameter of the tip circle of the male rotor is set to be substantially the same as that of the pitch circle of the female rotor.

A screw compressor or expander is constructed as follows. A pair of screw rotors of this type are rotatably housed inside a cylinder space comprising two cylindrical bores formed in a casing. The cylindrical bores have parallel axes and have diameters equal to the outer diameter of the respective rotors to be arranged therein. The distance between the axes of the cylinders is shorter than the sum of the radii thereof, and the axial length of each cylindrical bore is the same as that of the rotors. The two end portions of the cylindrical bores are closed with end plates fixed to the casing. Inlet and outlet ports for the fluid are formed at predetermined positions of the casing.

When the above assembly is used as a compressor, the female rotor and the male rotor are respectively rotated in the opposite direction with respect to each other. With respect to the concave tooth profile of the groove of the female rotor, a curve at the front side along the rotating direction is referred to as the leading side tooth profile, and that at the rear side along the rotating direction is referred to as the trailing side tooth profile. Similarly, with respect to the convex tooth profile of the land of the male rotor, that at the front side along the rotating direction is referred to as the leading side tooth profile, and that at the rear side along the rotating direction is referred to as the trailing side tooth profile.

When the above assembly is used as an expander, the names of the respective curves are reversed. However, in the description of the present invention, the respective tooth profile curves will be explained in accordance with the above definitions.

FIGS. 3(*a*) and 3(*b*) show the respective tooth profile curves when the rotors are cut along a plane perpendicular to their rotating axes. FIG. 3(*a*) shows the phases of the tooth profiles of the two rotors immediately after the trailing side tooth profile curves of the male and female rotors have begun to contact each other. When the male rotor is rotated through about 20° thereafter, the phases as shown in FIG. 3(*b*) are obtained wherein the highest portion of the tooth profile of the male rotor opposes the deepest portion of the groove of the tooth profile of the female rotor.

The above tooth profiles are ones disclosed in U.S. Pat. No. 4,576,558 granted to the present inventors and have the following characteristics.

Referring to FIGS. 3(*a*) and 3(*b*), reference numeral 1 denotes a male rotor; and 2 a female rotor meshed therewith. The rotors 1 and 2 rotate about centers of rotation 3 and 4 (centers of the pitch circles) inside cylindrical bores of a casing (not shown) in the direction indicated by arrows, respectively, so as to serve as a fluid compressor. Reference numerals 15 and 16 respectively denote pitch circles of male rotor 1 and female rotor 2. A line connecting the centers of rotation 3 and 4 passes a contact point 17 between the pitch circles 15 and 16, i.e., a pitch point 17.

The above-mentioned tooth profiles disclosed in U.S. Pat. No. 4,576,558 will be described with reference to FIG. 3(*b*).

(1) Female Rotor Tooth Profile

A curve ($H_2$-$A_2$) connecting a point $H_2$ at a tip of an addendum (Af) and a point ($A_2$) located on the pitch circle of the rotor is a generated curve of a point ($A_1$) located on the pitch circle of the male rotor tooth profile; a portion between said point ($A_2$) and a point ($B_2$) is formed by a circular arc having a radius ($R_7$) having a center $O_7$ which is located on a line tangent to the pitch circle at the point ($A_2$) and located outside the concave of the groove; a portion between the point ($B_2$) and a point ($C_2$) is formed by an envelope developed by a circular arc ($B_1$-$C_1$) which is a part of the male rotor tooth profile; a portion between points ($D_2$) and ($E_2$) is formed by a circular arc having a radius ($R_1$) having a center ($O_1$) outside the female rotor pitch circle; a portion between points ($C_2$) and ($D_2$) is formed by a common tangent of said curves ($B_2$-$C_2$) and ($D_2$-$E_2$); a portion between points ($E_2$) and ($F_2$) is formed by a circular arc having a radius ($R_2$) and a center ($O_2$) located outside the groove on an extension of a line ($O_1$-$E_2$) intersecting at an angle ($\theta_1$) with a straight line connecting the centers of rotation of the rotors at the point ($O_1$); and a portion between points ($F_2$) and ($G_2$) is formed by a circular arc having a radius ($R_8$) and a center ($O_8$) of the arc being located on a straight line ($O_2$-$F_2$), said circular arc being in contact with a circular arc ($G_2$-$H_2$) of the same radius as the outer diameter of the female rotor at the point ($G_2$).

(2) Male Rotor Tooth Profile

A tooth profile of the male rotor is formed such that a curve ($H_1$-$A_1$) connecting a point ($H_1$) located on a bottom land of a dedendum (Dm) and the point ($A_1$) located on the pitch circle; is a generated curve of a point $H_2$ located on the female rotor tooth profile, a portion between the points ($A_1$) and ($B_1$) is an envelope developed by the arc ($A_1$-$B_2$) which is a part of the female rotor tooth profile, a portion between a point ($B_1$) and a point ($C_1$) is formed by a circular arc having a radius ($R_4$) and a center $O_4$ of the arc located on a line intersecting at an angle ($\theta_{r5}$) with the line (3-4) from the rotating centers of the male rotor, a portion between the point ($C_1$) and a point ($D_1$) is formed by a circular arc ($C_1$-$D_1$) having a radius ($R_5$) and a center of the arc at the rotating center of the male rotor; a portion between a point ($D_1$) and a point ($E_1$) is formed by an envelope ($D_1$-$E_1$) developed by an arc ($D_2$-$E_2$) which is a part of the female rotor tooth profile, a portion between a point ($E_1$) and a point ($F_1$) is formed by an envelope ($E_1$-$F_1$) developed by an arc ($E_2$-$F_2$) which is a part of the female rotor tooth profile, and a portion between the points ($F_1$) and ($G_1$) is formed by an envelope ($F_1$-$G_1$) developed by the arc ($F_2$-$G_2$).

The above-described tooth profiles have the following advantages:

(1) The center $O_4$ of the arc ($B_1$-$C_1$) having the radius $R_4$ is located on the radial line (3-$C_1$) extending from the rotating center 3 of the male rotor, the angle $\theta_{r5}$ formed with respect to a straight line 3-4 is set in the range (4°–8°) not to lower the performance to be located away from the line 3-4, whereby the volume of a space 18 (see FIG. 3(*b*)) formed between a contact point, between said circular arc $B_1$-$C_1$ of the male rotor and the envelope $B_2$-$C_2$ on the trailing side of the female rotor generated by said circular arc $B_1$-$C_1$, and the point $B_2$ at the tip of the female rotor can be further decreased as compared with that of a space 18' of the tooth profile (shown in FIG. 4) of the screw rotor machine proposed in Japanese Patent Publication Gazette No. 56-17559. Therefore, the power loss due to the vacuum formation as a result of expansion of said space 18 during the rotation of the rotor is small.

(2) Since the tooth profile curve on the trailing side of the female rotor and a part of the tooth profile curve on the leading side of the male rotor are the envelopes $B_2$-$C_2$ and $D_1$-$E_1$ developed by the circular arcs $B_1$-$C_1$ and $D_2$-$E_2$ respectively, the sliding surfaces of the teeth provide surface contact and the wear resistance in the sliding surfaces increases.

(3) Since the sliding surfaces of the teeth provide surface contact, when a lubricating fluid is supplied, lubricating and sealing effects can be improved by the wedging effect. In this manner, the wear resistance and the seal can be improved, and a lowering of efficiency after the use of screw rotors over a long period of time can be prevented.

(4) The line $C_2$-$D_2$, the contour line of the bottom land of the tooth of the female rotor is a common tangent to the line $B_2$-$C_2$ and line $D_2$-$E_2$, and therefore, in an end wall 68 on the outlet side shown in FIG. 2(*a*), when the outlet port is closed immediately before the end of the output stroke, the compressed air trapped within the space 73 (see FIG. 3(*b*)) during the progress of engagement between both the male and female rotors, the residual sealing lubricating oil is discharged into a space 49 (see FIG. 2(*b*)) on the adjoining intake side as shown in FIG. 3(*c*) as the curve $D_1$-$E_1$ and $D_2$-$E_2$ of the tooth profiles of both the male and female rotors separate from each other. Thus, overcompression of said gas and liquid can be prevented.

Accordingly, a means wherein a bypass hole is provide in the end wall 68 on the outlet side (as has been proposed in Japanese Patent Application Laid-Open Gazette Nos. 58-214693 and 58-131388) to escape said gas and lubricating oil into the space on the low pressure side, need not be provided. Vibrations, noises and power loss can be prevented.

(5) Since the bottom of the profile of a cutter cutting the tooth profile of the rotors can be widened, the pressure angle can be increased, machining precision of the teeth is improved, and the tool life can be extended.

On the other hand, since a portion between contact points between the curve $B_1$-$C_1$ which is the top of the male rotor and the circular arc $D_2$-$E_2$ of the radius $R_1$ on the leading side of the female rotor is wide, the width of seal due to the engagement with the female rotor widens and the width of a seal between the inner peripheral surface of the cylinder and the top of the male rotor also widens. As a result, thermal scattering resulting from the friction between the seals and the compression heat is deteriorated and a burning between both the rotors and the cylinder tends to occur.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts through the several views and wherein.

SUMMARY OF THE INVENTION

Figure 3A:
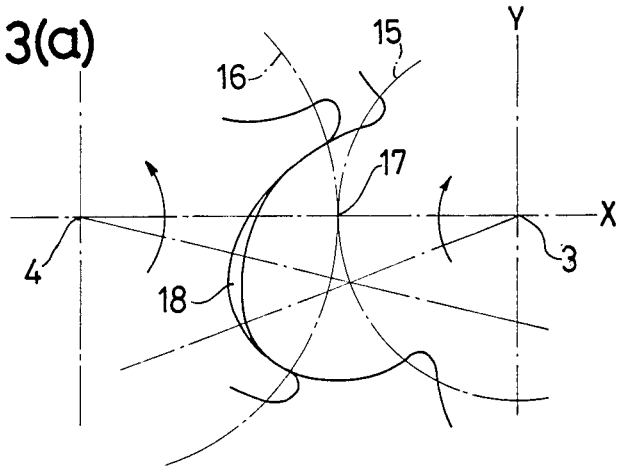
FIGS. 3(*a*) to 3(*c*) are respectively sectional views showing the tooth profile curves of the screw rotor which forms the basis of the present invention, in which FIG. 3(*a*) is a sectional view showing the phase immediately after the meshing of tooth profiles of both female and male rotors, FIG. 3(*b*) is a sectional view showing the essential parts of said tooth profile curve, and FIG. 3(*c*) is a sectional view showing the essential parts when the outlet is closed immediately before termination of outlet stroke in the end wall of the outlet side.
Figure 3B:
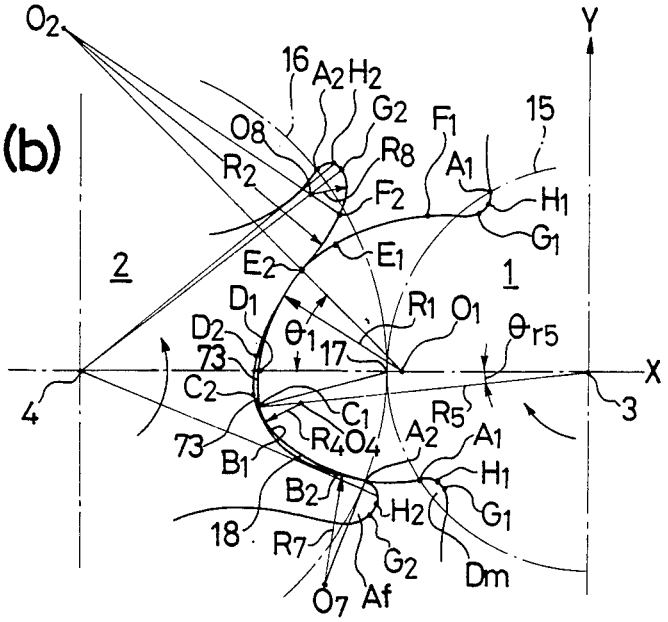
Figure 3C:
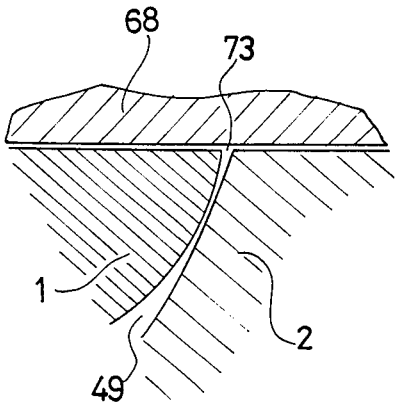

It is therefore an object of the present invention not to impair the advantage of the tooth profiles shown in FIGS. 3(*a*) to 3(*c*) previously proposed by the U.S. Pat. No. 4,576,558 and to make better the thermal diffusion in the top of the male rotor whereby extending the service life of the screw rotor and minimizing a leak in a space where compression involves to enhance the performance. It is a further object of the invention to provide a screw rotor assembly which is formed, in the top of the tooth profile of the male rotor in a surface vertical to a rotary shaft of the male rotor, with a flat portion substantially vertical to a line connecting rotating centers of the female rotor and male rotor and a sealing strip projected from said flat portion to the female rotor without changing the tooth profile of the female rotor as described in said U.S. Pat. No. 4,576,558.

The line connecting the rotating centers of the male rotor and female rotor herein termed is a straight line depicted by connecting the rotating center of the female rotor and the rotating center of the male rotor as reference lines, in preparing a contour line of a tooth profile of the female rotor and a contour line of a tooth profile of the male rotor on a sheet of paper.

DESCRIPTION OF THE PREFERRED EMBODIMENTS

The tooth profiels according to a preferred embodiment of the present invention will now be described with reference to the accompanying drawings.

Figure 2A:
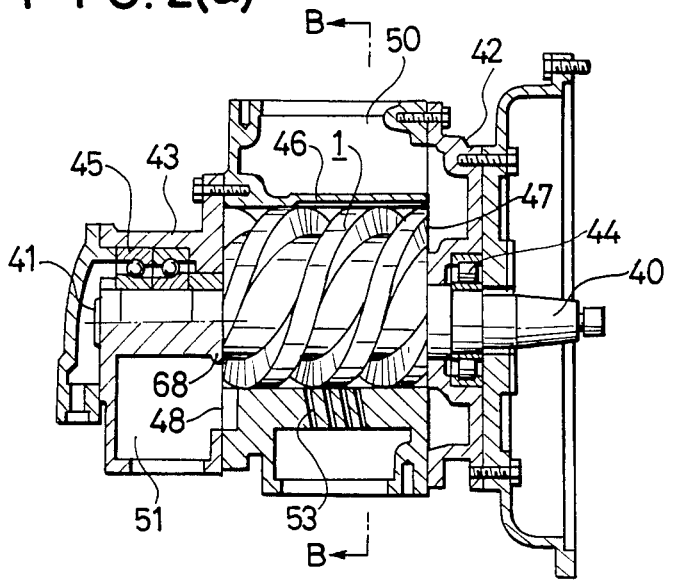
FIGS. 2(*a*) and 2(*b*) are respectively sectional views of a compressor when the screw rotor of the present invention is incorporated, in which FIG. 2(*a*) is a side sectional view taken on line A—A and FIG. 2(*b*) is a cross sectional view taken on line B—B.
Figure 2B:
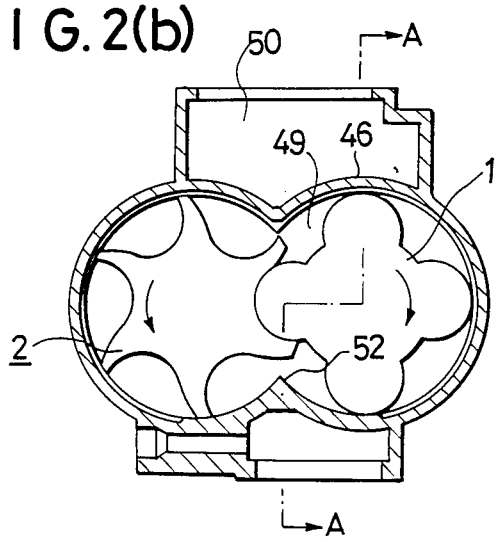

FIG. 2 shows a compressor for a compressible fluid according to the present invention. FIG. 2(*a*) is a side sectional view along the line A—A in FIG. 2(*b*), and FIG. 2(*b*) is a cross-sectional view along a line B—B in FIG. 2(*a*). In these figures, reference numeral 1 denotes a male rotor which is driven by a rotating shaft 40 coupled to a prime mover (not shown) and rotatably supported by bearings 44 and 45 mounted on end plates 42 and 43 by the rotating shaft 40 and a support shaft 41 extending symmetrically and coaxially with the rotating shaft 40 with respect to the rotor 1. Reference numeral 2 denotes a female rotor meshing with the male rotor 1. The rotor 2 is rotatably supported by the end plates 42 and 43 by supporting shafts extending coaxially with the female rotor 2. Reference numeral 46 denotes a casing surrounding the outer circumferences of the meshing rotors 1 and 2. The low-pressure side end plate 42 having an inlet port 47 and the high-pressure side end plate 43 having an outlet port 48 are coupled at the end faces of the casing 46 along its axial direction. A working space 49 is defined by the teeth of the rotors, surfaces of grooves, inner surface of the casing and inner walls of the end plates. The working space 49 communicates the inlet port 47 and the outlet port 48 which respectively communicate with a low-pressure path 50 and a high-pressure path 51 for the working fluid formed on the casing 46. The sectional area of the working space 49 corresponds to a combined area of two parallel cylindrical spaces, the distance between the central axes of the two cylinders is smaller than the sum of the radii of the respective cylinders; the two cylinders have an overlapping portion and therefore have ridge lines 52 at which the inner walls thereof intersect as well shown in FIG. 2(*b*).

The female rotor 2 is provided with six helical grooves with a wrap angle of about 200° along the rotating axis (longitudinal axis) of the rotor 2. Major portions of the grooves are located inside the pitch circles of the rotor 2. The height of each tooth between adjacent grooves is slightly larger than the pitch circumference, and the profile of the grooves have inwardly concave curves.

The male rotor 1 is provided generally with four helical lands or teeth having a wrap angle of about 300° along the rotating axis (longitudinal axis) of the rotor 1. Each tooth has two flanks provided with a generally convex profile, the major portion thereof is located outside the pitch circle and the remainder thereof is located inside the pitch circle. Each two adjacent teeth define a groove for receiving a tooth of the rotor 2 between said flanks. The working space 49 has a V-shape. Upon rotation of the rotors, communication between the inlet port 47 of the low-pressure side end plate 42 and the working space 49 is shielded. Thereafter, as the meshing line (sealing line) of the tooth profiles of the two rotors shifts (relative to the rotation of the rotors), the volume of the working space 49 is reduced to that before being completely sealed. During this time, the fluid is adiabatically compressed and increased in pressure and temperature. When the working space communicates with the outlet port 48 formed in the high-pressure end plate 43, it supplies the compressed fluid to the side of the high-pressure path 51.

During this time, the cooled lubricating fluid is injected into the working space through a nozzle 53 in order to lubricate meshing between the rotor teeth and groove surfaces, the sliding surfaces between the inner wall of the casing and radial end surfaces of the teeth of rotors, the sliding between axial end faces of the rotors and inner side surfaces of the end plates, to seal the working space and to prevent a temperature increase due to the compression of the fluid.

Figure 4:
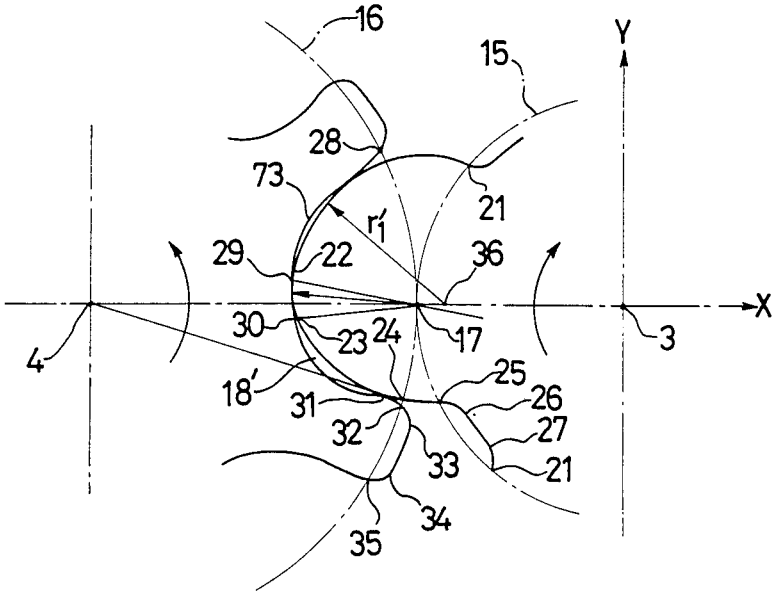
FIG. 4 is a sectional view showing the essential parts of one embodiment of tooth profile curves of the screw rotor heretofore proposed.

The present invention relates to the tooth profile curves of the screw rotors used for the rotary machine such as the compressor. Since those identical with names of parts shown in FIGS. 2 to 4 have the same function, the same reference numerals are used for explanation.

FIG. 1(*a*) is a sectional view of a tooth profile curve of screw rotors in one embodiment of the present invention, and FIG. 1(*b*) is a fragmentary enlarged view of a top of a male rotor and shows a tooth profile curve which is cut at one plane perpendicular to the respective rotating shafts of the female and male rotors. Reference numeral 1 denotes a male rotor; and 3 a center of rotation of the male rotor 1, i.e., the center of a pitch circle 15 of the male rotor tooth profile. The male rotor 1 meshes with a female rotor 2 and rotates about the center 3 in the direction indicated by an arrow. Reference numeral 2 denotes a female rotor; and 4 a center of rotation thereof, i.e., the center of a pitch circle 16 of the female rotor tooth profile. The rotor 2 meshes with the male rotor 1 and rotates about the rotating center 4 in the direction indicated by an arrow. Reference numeral 17 denotes a pitch point. Center 3, pitch point 17 and center 4 are located on a straight line. The pitch circles 15 and 16 circumscribe each other at point 17. Reference numeral 18 denotes a vacuum space (vacuum producing space) formed between tooth profiles of rotors 1 and 2.

It is noted that the tooth profile curve of the female rotor is the curve exactly the same as that proposed by U.S. Pat. No. 4,576,558.

Note that symbol Af denotes an addendum formed externally of the pitch circle 16 of the female rotor, Dm a dedendum formed internally of the pitch circle 15 of the male rotor. Point $A_1$ located on the tooth profile of the male rotor is a point on the pitch circle 15, and point $A_2$ located on the tooth profile of the female rotor is a point on the pitch circle 16.

(1) Female Rotor tooth Profile (i) Trailing side curve: from the outermost point toward the bottom of the groove, (a) curve ($H_2$-$A_2$); a curve generated by the point $A_1$ which is located on the male rotor tooth profile at a point where the profile intersects with the pitch circle 15 and circumscribe curve ($A_2$-$B_2$) at the point $A_2$ located on the pitch circle 16 of the female rotor 2.

(b) curve ($A_2$-$B_2$); a circular arc having a radius $R_7$ with a center of the arc $O_7$ located on a straight line circumscribing the pitch circle 16 at the point $A_2$ and outside the concave of the groove.

(c) curve ($B_2$-$C_2$); an envelope developed by an arc ($B_1$-$C_1$) which is a part of the male rotor tooth profile and tangentially connected with the curve ($A_2$-$B_2$) at a point $B_2$.

(d) curve ($C_2$-$D_2$); a common tangent of an envelope developed by the arc ($B_1$-$C_1$) which is a part of the male rotor tooth profile (an extension thereof intersects with the line (3-4) at a point $C_2'$), and a circular arc having a radius $R_1$ and a center of the arc $O_1$ on the line (3-4) and outside the pitch circle 16. This curve ($C_2$-$D_2$) can be a smooth curve similar to a circular arc having a radius $R_5$ and a center (3) of the arc.

(ii) Leading side curve: from the straight line (3-4) toward an outermost point.

(e) curve ($D_2$-$E_2$); a circular arc having a radius $R_1$ and a center of the arc $O_1$ located on the line (3-4) and outside the pitch circle 16. The arc is tangent to a curve ($E_2$-$F_2$) at a point $E_2$. One extension of the arc ($D_2$-$E_2$) intersects the line (3-4) at a point $D_2'$.

(f) curve ($E_2$-$F_2$); a circular arc having a radius $R_2$ and a center of the arc $O_2$ located opposite the point $O_1$ on an extension of straight line ($O_1$-$E_2$) which is intersecting the line (3-4) with an angle $\theta_1$ between the line (3-4) at the point $O_1$ located outside the pitch circle 16 of the female rotor. The arc is convex toward the male rotor and tangent to a curve ($F_2$-$G_2$) at a point $F_2$.

The angle $\theta_1$ is 40° to 55° and satisfies an inequality $1.05 \leqq (R_1/(R_5\text{-PCR}) \leqq 1.3$. Note that PCR is the pitch circle radius of the male rotor.

The larger the value of $R_1/(R_5\text{-PCR})$ is greater than 1 and the smaller the value of the angle $\theta_1$, the larger the pressure angle near the pitch circle of the tooth profile constituting the curve ($C_2$-$E_2$) can be established. The closer the value of $R_1/(R_5\text{-PCR})$ is to 1 and the larger the value of the angle $\theta_1$, the larger the thickness of the tooth of the female rotor can be established.

In this embodiment, the pressure angle can be set to be sufficiently large, and the above ranges of $R_1$ and $\theta_1$ are set for assuring a tooth thickness with satisfactory strength.

(g) curve ($F_2$-$G_2$); a circular arc having a radius $R_8$ and a center of the arc $O_8$ located on a straight line ($O_2$-$F_2$) and outside the concave of the groove. The arc circumscribes the arc ($E_2$-$F_2$) at the point $F_2$ and circumscribes a circular arc having a radius equal to the outer diameter of the female rotor at a point $G_2$.

(h) curve ($G_2$-$H_2$); a circular arc having a radius the same as the outer diameter of the female rotor and has a length from 0.01 to 0.004 times PCD of the male rotor.

(2) Male Rotor Tooth Profile

The male rotor tooth profile relative to the above-described female rotor tooth profile is formed by the following lines:

(i) Trailing side curve; from an innermost point to the tip, (a) curve ($H_1$-$A_1$); a line generated by a point $H_2$ located on the female rotor tooth profile. The line is tangent to an arc of the male rotor tooth bottom land at a point $H_1$.

(b) curve ($A_1$-$B_1$); an envelope generated by an arc ($A_2$-$B_2$) which is part of the female rotor tooth profile. The envelope is tangent to a curve ($B_1$-$C_1$) at a point $B_1$.

(c) curve ($B_1$-$C_1$); a circular arc having a short radius $R_4$ and a center of the arc $O_4$ located on a radial line $R_5$ extending from the center of the male rotor and intersecting the line (3-4) at a point 3 with an angle $\theta_5$. The angle $\theta_5$ is between 4° and 8° and is relatively large. For this reason, the center of the arc $O_4$ is distant from the line (3-4). The radius $R_4$ is about 0.05 to 0.07 times of PCD of the male rotor.

(d) line ($C_1$-$WL_1$); a straight line tangents to said circular arc $B_1$-$C_1$ at a point $C_1$ and connecting the point $C_1$ and a point $WL_1$. The point $WL_1$ is located on the side of the point $C_1$ relative to the straight line 3-4 and is distant from the straight line 3-4 through a predetermined dimension.

(ii) Leading side curve; from the tip to an innermost point on the opposite side, (e) curve ($D_3$-$E'_1$): a convex circular arc having a short radius $R_6$ located on the side opposite said radial line $R_5$ relative to the straight line 3-4 and a center of the arc $O_6$ located on a radial line $R_{10}$ extending from the center of the male rotor and intersecting the line 3-4 at a point 3 with an angle $\theta_6$. Here, the angle $\theta_6$ is about 3° to 6°, and the radius $R_6$ is about 0.05 to 0.07 times of PCD of the male rotor. Note that the curve $D_3$-$E'_1$ can be a circular arc or similar curve wherein said curve $E'_1$-$E_1$ and curve $WL_2$-$D_3$ described later have been prepared, said circular arc or similar curve which is convex having a small radius and tangent to said two curves at point $E'_1$ and $D_3$.

(f) curve $E'_1$-$E_1$; an envelope generated by the arc ($D_2$-$E_2$) having a radius $R_1$ which is a part of the tip curve of the female rotor. The envelope is tangent to the arc $D_3$-$E'_1$ at the point $E'_1$.

(g) line $D_3$-$WL_2$; a straight line vertical to the straight line 3-4 and is tangent to the arc $D_3$-$E'_1$ at the point $D_3$. The point $WL_2$ is located on the side of the point $D_3$ relative to the straight line 3-4 and is spaced from the straight line 3-4 along the extension of the straight line $D_3$-$WL_2$ through a predetermined dimension.

(h) curve $E_1$-$F_1$; an envelope generated by the arc $E_2$-$F_2$ having a radius $R_2$ which is a part of the female rotor tooth profile. The envelope is tangent to the envelope $E'_1$-$E_1$ at the point $E_1$.

(i) curve $F_1$-$G_1$; an envelope generated by the arc $F_2$-$G_2$ having a radius $R_8$ which is a part of the female rotor tooth profile. The envelope is tangent to the envelope $E'_1$-$F_1$ at the point $F_1$.

(j) curve $G_1$-$H_1$; a concave curve connecting points $G_1$ and $H_1$.

(iii) Sealing Strip 75

(k) curve $WD_1$-$WD_2$; this curve has points $WD_1$ and $WD_2$ at both ends on a circular arc 81 having the same radius as the outer diameter of the male rotor, the curve $WD_1$-$WD_2$ can be either a circular arc having the same radius as the outer diameter of the male rotor or a straight line. The points $WD_1$ and $WD_2$ are respectively spaced from the line 3-4 through a length W/2 vertically of the line 3-4.

(l) line $WD_1$-$WL_1$ and line $WD_2$-$WL_2$: a line $WD_1$-$WL_1$ is a straight line or similar concave curve connecting the point $WD_1$ located at one end of the line $WD_1$-$WD_2$ and the point $WL_1$ located on the line $C_1$-$WL_1$, and a line $WD_2$-$WL_2$ is a straight line or similar concave curve connecting the point $WD_2$ located on the other end of the line $WD_1$-$WD_2$ and the point $WL_2$ located on the line $D_3$-$WL_2$. The extension lines of the lines $WD_1$-$WL_1$ and $WD_2$-$WL_2$ extended to outside the contour line of the tip of the male rotor can be in parallel with the line 3-4 connecting rotating centers 3 and 4 of the male and female rotors or preferably intersect the line 3-4 at one point. Preferably, an angle $\theta_7$ between each of the extension lines of lines $WD_1$-$WL_1$ and $WD_2$-$WL_2$ and said line 3-4 is in the range from 0 to 45 degrees. The point $WL_1$ may be positioned on the extension line of the line $D_3$-$WL_2$. Preferably the points $WL_1$ and $WL_2$ may be positioned on a common tangent to the curved $B_1$-$C_1$ and $D_3$-$E'_1$ which is tangent to the curve $B_1$-$C_1$ at the point $C_1$ and to the curve $D_3$-$E'_1$ at the point $D_3$.

It should be noted that in order to render the pressure angle of the working tool always positive, the curve $H_1$-$A_1$ of the male rotor tooth profile can be formed such that a curve connecting the point $H_1$ and a point $H'_1$ is a circular arc having a radius $R_9$ and a center of the arc being located outside of the male rotor tooth profile and a straight line $H'_1$-$A_1$ which is tangent to the curve $H_1$-$H'_1$ at the point $H'_1$ as shown in FIG. 1(*c*) and the curve $H_2$-$A_2$ of the female rotor profile can be formed such that a curve connecting the points $H_2$ and $H'_2$ is an envelope developed by said curve $H'_1$-$A_1$ of the male rotor tooth profile and a curve $H'_2$-$H_2$ is a circular arc having the radius $R_9$ and a center of the arc inside the female rotor tooth profile as shown in FIG. 1(*d*). The radius $R_9$ is then about 0.01 to 0.07 times of PCD of the male rotor.

In an another embodiment of the present invention each of line $WD_1$-$WL_1$ and line $WD_2$-$WL_2$ of the sealing strip can be formed by a concave circular arc having a radius of 0.1–0.3 times of the pitch circle radius of the male rotor and a center of the arc outside the male rotor tooth profile which is tangent to said each of the lines $WD_1$-$WL_1$ and $WD_2$-$WL_2$ at points $WL_1$ and $WL_2$. This profile of the sealing strip makes machining thereof easy.

(Advantages of the Invention)

As mentioned above, according to the present invention, the above-described tooth profile curves are formed on the basis of the tooth profile curves proposed by U.S. Pat. No. 4,576,558 whereby the present invention can retain the characteristics of the tooth profile curves of the rotors proposed by said patent, namely, the vacuum spaces generated in the trailing side of both the rotors can be reduced; sealing and wear-resistance of the sliding portions produced by the meshing between both the rotors can be enhanced; and the vibrations, noises and power loss resulting from the overcompression of the residual fluid when the outlet is closed immediately before the termination of discharge stroke in addition to operation and effect such as longer service life of the working tools. The invention further provides the following operation and effects.

Figure 1A:
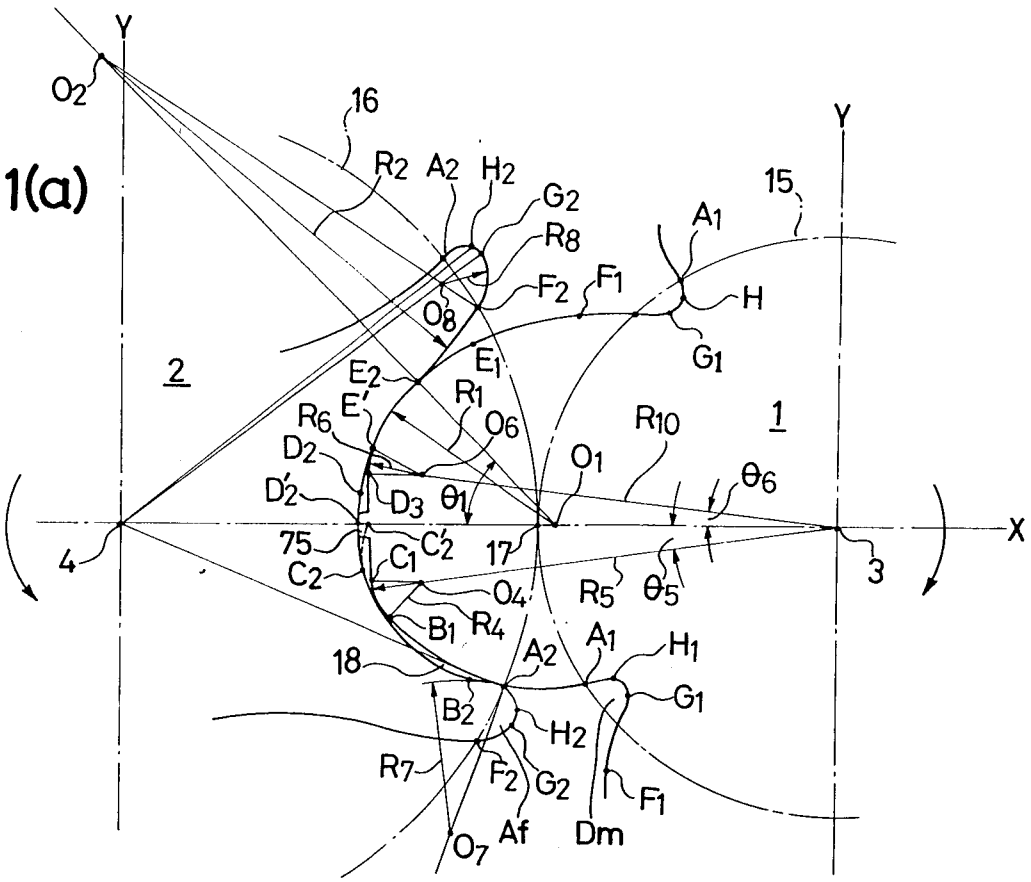
FIGS. 1(*a*) to 1(*d*) are respectively sectional view of tooth profile curves in accordance with one embodiment of a screw rotor according to the present invention, in which FIG. 1(*a*) shows the whole structure with a part of said curve omitted, FIG. 1(*b*) is a fragmentary enlarged view of a tip of tooth of a male rotor, FIG. 1(*c*) is a fragmentary enlarged view of a dedendum of the male rotor in the modified form, and FIG. 1(*d*) is a fragmentary enlarged view of a tip of tooth of the female rotor in said modified example.
Figure 1B:
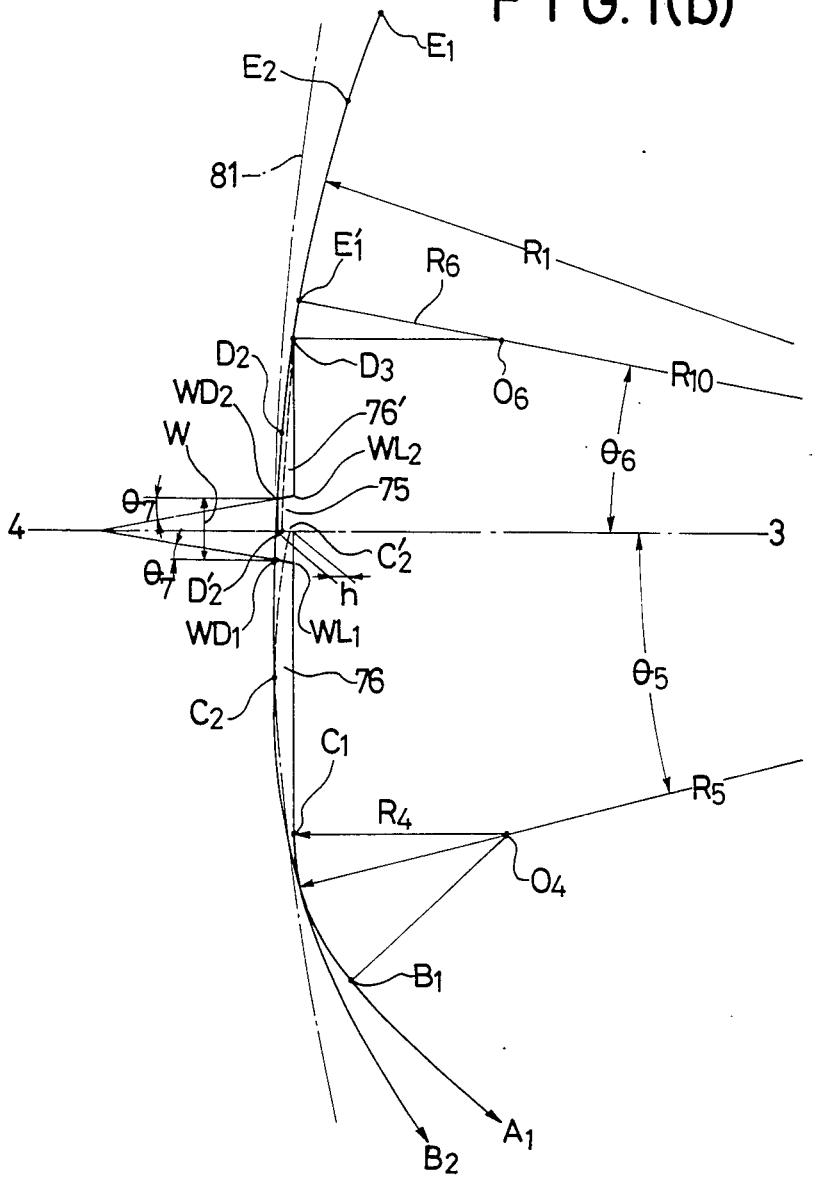
Figure 1C:
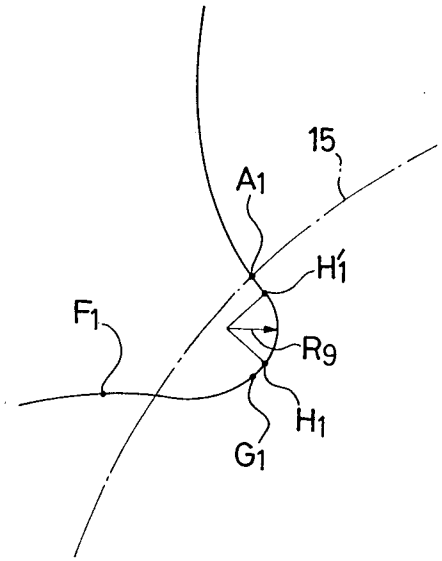
Figure 1D:
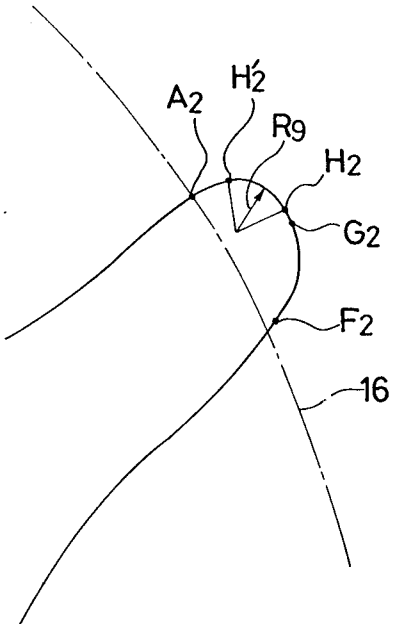

(1) Spaces 76, 76' which are so small as not to lower the performance are formed through the seal strip 75 betwen the curve $B_2$-$C_2$-$D_2$-$E_2$ of the tooth bottom of the female rotor (FIGS. 1(a) and (b)) and the curves $B_1$-$C_1$ and $D_3$-$E'_1$ of the tooth tip of the male rotor. A part of lubricating oil injected into compression acting spaces during operation remains within the aforesaid spaces to provide cooling of the tooth bottom of the female rotor and the tooth tip of the male rotor.

Further, the aforesaid lubricating oil is to simultaneously effect sealing and lubricating actions between the curves of grooves of the female rotor and the line $B_1$-$C_1$ and line $D_3$-$E_1$ which form a part of the tooth profile curve of the male rotor to thereby prevent a trouble resulting from the burning of the rotors and deterioration in performance due to the leakage.

Figure 5A:
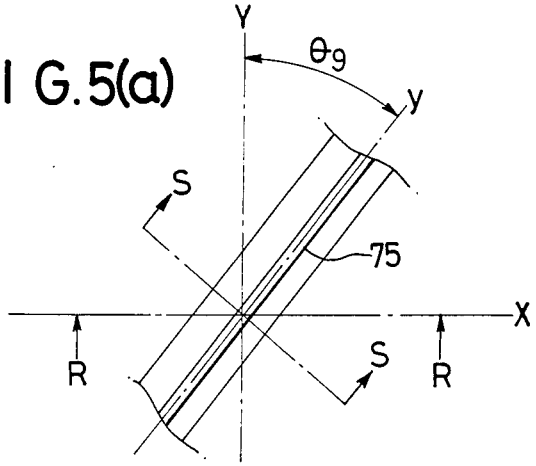
FIGS. 5(*a*) to 5(*c*) show the comparison of edge tops of the male rotor according to the present invention and the male rotor heretofore generally used in which FIG. 5(*a*) is an explanatory view of the tip of tooth when the male rotor is viewed in plane, FIG. 5(*b*) is a sectional view thereof, and FIG. 5(*c*) is a sectional view when it is viewed at torsional right angles.
Figure 5B:
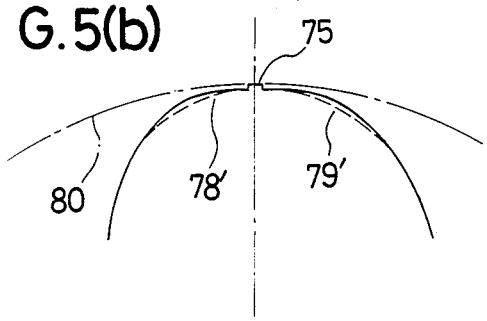
Figure 5C:
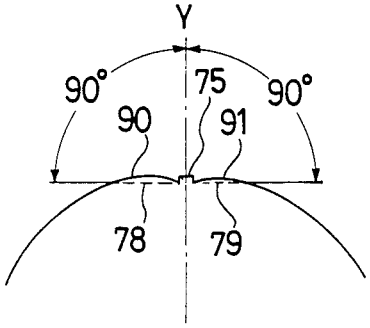

Moreover, sealing, cooling and lubrication of the tooth tip are carried out between the inner peripheral surface 80 of the cylinder (see FIG. 5(*b*)) and the tooth tip of the male rotor by the sealing lubricating oil remaining in the spaces 76, 76' in a manner similar to the former, and therefore, there occurs less leak and no trouble due to the burning.

(2) In the past, generally, where the seal strip 75 is provided on the tooth top of the male rotor, the straight line $WL_1$-$C_1$ and straight line $WL_2$-$D_3$ shown in FIG. 1(*b*) were usually processed linearly as in the broken lines 78, 79 shown in FIG. 5(*c*) with respect to the torsional right angle direction S-S (see FIG. 5(*a*)) of the male rotor. FIG. 5(*a*) is a view in which male rotor is viewed in plane with respect to the rotating shaft Y; FIG. 5(*b*) shows a section R-R at right angles to the rotating shaft Y; and FIG. 5(*c*) shows a section S-S at right angles to the center line y which forms the torsional angle $\theta_9$ with respect to the rotating shaft Y. Therefore, when viewed in the direction of the section R-R at right angles to the rotating shaft Y, there appears a gentle curve being oriented downwardly toward the flank from the root of the seal strip 75 as in the broken lines 78', 79' shown in FIG. 5(*b*). More specifically, a packing portion for the inner peripheral portion of the cylinder merely comprises the aforesaid seal strip 75, thus failing to provide a sufficient seal for a leak of gas from the compression acting space.

On the other hand, according to the present invention, as described above, all the contour lines of the tooth profiles of the female and male rotors are defined by the contour lines in the surface vertical to the rotating shaft, and therefore, even if the portion betwen the line $WL_1$-$C_1$ and line $WL_2$-$D_3$ of FIG. 1(*b*) is formed by a straight line in the section R-R at right angles to the rotating shaft Y, there is formed a curve which ascends from the bottom of the seal strip 75 toward the tooth root in the section at right angle to the center line of the torsional angle. Accordingly, the curves $B_1$-$C_1$ and $D_3$-$E'_1$ shown in FIGS. 1(*a*) and (*b*) are closer to the inner peripheral surface 80 of the cylinder (see FIG. 5(*b*)), and therefore, the sealing accuracy may be enhanced as compared with that of prior art. In other words, in the section at right angles to the center line of the torsional angle, both shoulders of the flank from the root of the seal strip to the bottom of the male rotor is a convex curve as in solid lines 90, 91 shown in FIG. 5(*c*).

With this, the sealing portion between the inner peripheral surface 80 of the cylinder and the tooth tip of the male rotor is more positively sealed by the curve $B_1$-$C_1$, the seal strip 75 and the curve $D_3$-$E'_1$, and therefore the leak of gas between the compression acting spaces may be minimized to thereby increase the performance.

(3) Furthermore, a conventional further method of forming a seal strip, as disclosed in Japanese patent Publication Gazette No. 56-17559, comprises setting a contour of a land of a rotor in relation to a curve of a groove of a female rotor, and thereafter cutting of the end of the male rotor land through a given depth leaving a seal strip. Therefore, in a border portion of the cut-off portion of the male rotor land, the curve of the land was discontinuous, providing an incomplete seal in a contact portion with the tooth groove of the female rotor. On the other hand, in accordance with the present invention, the seal strip is preset at the tip of the male rotor and the straight line $WL_1$-$C_1$ extending from the point $WL_1$ of the root of the seal strip is made to contact with the curve $B_1$-$C_1$, and therefore, the meshing portion between the curve $B_1$-$C_1$ and the tooth groove of the female rotor formed by the envelope of the aforesaid curve can be made into the surface sliding at the portion of said envelope, thus providing the positive seal of the sliding portion.

The following table shows the radius R of the angle portion of the tooth profile and the angle $\theta$ according to the present invention.

TABLE

| | |
|---|---|
| $R_1$ | 0.33–0.4 PCD |
| $R_2$ | 0.9–1.2 PCD |
| $R_4$ | 0.05–0.07 PCD |
| $R_6$ | 0.05–0.07 PCD |
| $R_7$ | 0.2–0.3 PCD |
| $R_9$ | 0.01–0.07 PCD |
| $\theta_1$ | 40°–46° |
| $\theta_5$ | 4°–8° |
| $\theta_7$ | 0°–45° |
| $\theta_6$ | 3°–6° |

What is claimed as new and desired to be secured by Letters Patent of the United States is:

1. A rotary machine having screw rotor assembly comprising a casing having an inner peripheral wall formed by two intersecting cylindrical wall surfaces whose axes are in parallel with each other and two end walls disposed vertically with respect to said axes at each axial end of said inner peripheral wall for forming a closed space in said casing, a male rotor having helical protrusions in the outer periphery thereof and a female rotor having helical concaves in the outer periphery thereof for receiving said protrusions of said mail rotor, said male and female rotors being disposed within said closed space formed in said casing to be rotatable and meshed with each other and an inlet and an outlet ports formed in said casing connected with said closed space formed in said casing, respectively, whereby a compressible fluid introduced in an acting space formed by both said rotors and inner peripheral walls of said casing through said inlet port is compressed or expanded during the rotation of said rotors and is discharged from said outlet port, characterized in that, a contour line of a tooth profile in a plane perpendicular to a rotating axis of said female rotor is such that a major concave portion except an addundum (Af) formed outside a pitch circle of meshing rotation with the male rotor is formed inside said pitch circle and a contour line of a tooth profile in a plane perpendicular to a rotating axis of said male rotor is such that a major portion except a dedendum (Dm) formed inside a pitch circle of meshing rotation with the female rotor is formed outside said pitch circle;

the tooth profile of the female rotor is formed such that a first portion ($G_2$-$H_2$) connecting two outermost points ($G_2$) and ($H_2$) located on tip of said addendum (Af) is formed by a circular arc having a radius equal to the outer diameter of said female rotor and a center of the arc being located at a rotating axis of said female rotor; a second portion ($H_2$-$A_2$) connecting said point ($H_2$) and a point ($A_2$) located on the pitch circle of said female rotor is generated by a point ($A_1$) located on the pitch circle of the male rotor tooth profile; a third portion ($A_2$-$B_2$) connecting said point ($A_2$) and a point ($B_2$) is formed by a convex circular arc having a radius ($R_7$) and a center ($O_7$) of the arc being located on a line tangent to the pitch circle of the female rotor at said point ($A_2$) and outside the tooth profile of the female rotor; a fourth portion ($B_2$-$C_2$) connecting said point ($B_2$) and a point ($C_2$) is formed by an envelope developed by a circular arc ($B_1$-$C_1$) which is a portion of the tooth profile of the male rotor; a fifth portion ($D_2$-$E_2$) connecting points ($D_2$) and ($E_2$) is formed by a concave circular arc having a radius ($R_1$) and center ($O_1$) of the arc being located on a line (3-4) connecting the rotation centers (3) and (4) of the male and female rotors and outside the pitch circle of the female rotor; a sixth portion ($C_2$-$D_2$) connecting said points ($C_2$) and ($D_2$) is formed by a common tangent or similar concave curve of said fourth portion ($B_2$-$C_2$) and fifth portion ($D_2$-$E_2$); a seventh portion ($E_2$-$F_2$) connecting said point ($E_2$) and a point ($F_2$) is formed a convex circular arc having a radius ($R_2$) and a center ($O_2$) of the arc being located on an extension of line ($O_1$-$E_2$) intersecting at an angle ($\theta_1$) with said line (3-4) at a position opposite to the center ($O_1$) of the fifth portion ($D_2$-$E_2$) with respect to the point ($E_2$) and an eighth portion ($F_2$-$G_2$) is formed by convex circular arc having a radius ($R_8$) and a center ($O_8$) of the arc being located on a line connecting said center ($O_2$) of said seventh portion ($E_2$-$F_2$) and said point ($F_2$);

the tooth profile of the male rotor is formed such that a first portion ($H_1$-$A_1$) connecting a point $H_1$located on a bottom land ($G_1$-$H_1$) of the dedendum (Dm) and the point ($A_1$) located on the pitch circle of the male rotor is a generated curve of the point $H_2$ located on the female rotor tooth profile; a second portion ($A_1$-$B_1$) connecting said point ($A_1$) and a point ($B_1$) is formed by an envelope developed by said the arc of said third portion ($A_2$-$B_2$) of the female rotor tooth profile; a third portion ($B_1$-$C_1$) connecting said point ($B_1$) and a point ($C_1$) is formed by a convex circular arc having a radius ($R_4$) and a center ($O_4$) of the arc being located on a line (3-$O_4$) intersecting at an angle ($\theta_5$) with said line (3-4) connecting the rotating centers (3) and (4) of said male and female rotors and at a predetermined distance apart from said line (3-4); a fourth portion ($E'_1$-$E_1$) connecting points ($E'_1$) and ($E_1$) is formed by an envelope developed by said arc of said fifth portion ($D_2$-$E_2$) of the female rotor tooth profile; a fifth portion ($E_1$-$F_1$) is formed by an envelope developed by said seventh portion ($E_2$-$F_2$) of the female rotor tooth profile, a sixth portion ($F_1$-$G_1$) is formed by an envelope developed by said eighth portion ($F_2$-$G_2$) of the female rotor tooth profile and a seventh portion ($C_1$-$E'_1$) is formed such that a portion ($E'_1$-$D_3$) connecting said point ($E'_1$) and a point ($D_3$) is formed by a convex circular arc having a radius ($R_6$) and a center ($O_6$) of the arc being located on a line (3-$O_6$) intersecting at an angle ($\theta_6$) with said line (3-4) which is tangent to said fourth portion ($E'_1$-$E_1$) at the point ($E'_1$); a portion ($C_1$-$WL_1$) connecting said point ($C_1$) and a point ($WL_1$) located at a predetermined distance apart from said line (3-4) and on the same side with the point ($C_1$) with respect to said line (3-4) which is tangent to said third portion ($B_1$-$C_1$) at the point ($C_1$); a portion ($D_3$-$WL_2$) connecting said point ($D_3$) and point ($WL_2$) located at a predetermined distance apart from said line (3-4)

and on the same side with the point ($D_3$) with respect to said line (3-4) which is tangent to said circular arc ($E'_1$-$D_3$) at the point ($D_3$); a portion ($WD_1$-$WD_2$) connecting two points ($WD_1$) and ($WD_2$) located on a circular arc having similar radius with the outer radius of the male rotor and a center of the arc being located on the rotating center of the male rotor and located opposite positions with resepct to said line (3-4) is formed by a line intersecting said line (3-4), and line ($WD_1$-$WL_1$) connecting said points ($WD_1$) and ($WL_1$) and line ($WD_2$-$WL_2$) connecting said points ($WD_2$) and ($WL_2$), respectively, are formed by a line whereby a seal strip portion formed by said portions ($C_1$-$WL_1$), ($WD_1$-$WL_1$), ($WD_1$-$WD_2$), ($WD_2$-$WL_2$) and ($D_3$-$WL_2$) is provided on the tip of the male rotor tooth profile.

2. The rotary machine according to claim 1, wherein the profile of said seal strip portion provided on said male rotor tooth profile is formed such that said portions ($C_1$-$WL_1$) and ($D_3$-$WL_2$) are existed on a common tangent to said third portion ($B_1$-$C_1$) and said fourth portion ($E'_1$-$D_3$) which is tangent to said third portion ($C_1$-$WL_1$) at the point ($C_1$) and to said fourth portion ($E'_1$-$D_3$) at the point ($D_3$).

3. The rotary machine according to claim 1, wherein the profile of said seal strip portion provided on said male rotor tooth profile is formed such that said portion ($WD_1$-$WL_1$) is a concave circular arc having a center of the arc being located outside of the male rotor tooth profile which intersects said portion ($WD_1$-$WL_1$) at the point ($WD_1$) and is tangent to said portion ($WD_2$-$WL_2$) is a concave circular arc having a center of the arc being located outside of the male rotor tooth profile which intersects said portion ($WD_1$-$WD_2$) at the point ($WD_2$) and is tangent to said portion ($D_3$-$WL_2$) at the point ($WL_2$).

* * * * *